US011668097B2

(12) United States Patent
Nielsen

(10) Patent No.: US 11,668,097 B2
(45) Date of Patent: Jun. 6, 2023

(54) BUILDING PANEL ADAPTED TO BE MOUNTED AT A CEILING OR WALL OF A ROOM AND METHOD OF MANUFACTURING SUCH BUILDING PANEL

(71) Applicant: Kvadrat Soft Cells A/S, Ebeltoft (DK)

(72) Inventor: Jesper Nielsen, Hamburg (DE)

(73) Assignee: Kvadrat Soft Cells A/S, Ebeltoft (DK)

( * ) Notice: Subject to any disclaimer, the term of this patent is extended or adjusted under 35 U.S.C. 154(b) by 185 days.

(21) Appl. No.: 17/059,239

(22) PCT Filed: May 29, 2019

(86) PCT No.: PCT/EP2019/064031
§ 371 (c)(1),
(2) Date: Nov. 26, 2020

(87) PCT Pub. No.: WO2019/229157
PCT Pub. Date: Dec. 5, 2019

(65) Prior Publication Data

US 2021/0207382 A1 Jul. 8, 2021

(30) Foreign Application Priority Data

May 29, 2018 (EP) ..... 18174886

(51) Int. Cl.
*E04F 13/00* (2006.01)
*E04F 13/08* (2006.01)
(Continued)

(52) U.S. Cl.
CPC ..... *E04F 13/0866* (2013.01); *E04B 9/0428* (2013.01); *E04F 13/12* (2013.01);
(Continued)

(58) Field of Classification Search
CPC .. E04B 9/0428; E04B 9/34; E04B 2009/0492; E04F 13/0835; E04F 13/0866; E04F 13/0883; E04F 13/12
(Continued)

(56) References Cited

U.S. PATENT DOCUMENTS 3,379,237 A * 4/1968 Worthington ..... E06B 9/52 160/371
3,729,045 A * 4/1973 MacDonald ..... E06B 9/52 52/476
(Continued)

FOREIGN PATENT DOCUMENTS

CN 1938486 A 3/2007
DE 1008470 5/1957
(Continued)

OTHER PUBLICATIONS

European Patent Office, International Search Report in International Application No. PCT/EP2019/064031 (dated Aug. 27, 2019) (3 pages).
(Continued)

*Primary Examiner* — Brian E Glessner
*Assistant Examiner* — James J Buckle, Jr.
(74) *Attorney, Agent, or Firm* — Neal, Gerber & Eisenberg LLP

(57) ABSTRACT

The panel includes a frame formed by profile members (6) and a plate member (10) extending therebetween. A textile (11) extends between the profile members which are formed by bending an edge area of a metal plate (15) forming the plate member (10), thereby forming said profile members in one piece with the plate member. Said edge area forms a rounded edge (16) connecting the plate member with the profile member. The profile member includes a first oblique section (21) of the metal plate forming an acute angle with
(Continued)

the plate member and having a first end being connected to the rounded edge. The textile is bent about the rounded edge, and an edge element (24) attached along an edge (12) of the textile is adapted to slide along the first oblique section and is spring-biased in the direction of a second end (23) of the first oblique section.

21 Claims, 16 Drawing Sheets

(51) Int. Cl.
*E04B 9/04* (2006.01)
*E04F 13/12* (2006.01)
*E04B 9/34* (2006.01)

(52) U.S. Cl.
CPC ..... *E04B 9/34* (2013.01); *E04B 2009/0492* (2013.01); *E04F 13/0835* (2013.01); *E04F 13/0883* (2013.01)

(58) Field of Classification Search
USPC ..... 52/797.1
See application file for complete search history.

(56) References Cited

U.S. PATENT DOCUMENTS 6,722,096 B2 * 4/2004 Von Arx ..... E04B 9/303 52/656.1
6,945,305 B1 * 9/2005 Limauro ..... E06B 9/52 160/369
7,735,540 B2 * 6/2010 Armstrong ..... E06B 9/24 160/371
8,074,411 B1 * 12/2011 Anderson ..... E04F 13/005 52/273
8,156,994 B2 * 4/2012 Armstrong ..... E06B 9/52 136/251
8,683,771 B2 * 4/2014 Sawyers ..... E06B 9/52 52/656.5

FOREIGN PATENT DOCUMENTS

| | | |
|---|---|---|
| DE | 2659722 | 7/1978 |
| ES | 2629454 | 8/2017 |
| WO | 2004/106663 | 12/2004 |
| WO | 2005/073482 | 8/2005 |
| WO | 2018/078416 | 5/2018 |
| WO | 2019/229157 | 12/2019 |

OTHER PUBLICATIONS

European Patent Office, Written Opinion of The International Search Authority in International Application No. PCT/EP2019/064031 (dated Aug. 27, 2019) (8 pages).

* cited by examiner

BUILDING PANEL ADAPTED TO BE MOUNTED AT A CEILING OR WALL OF A ROOM AND METHOD OF MANUFACTURING SUCH BUILDING PANEL

CROSS-REFERENCE TO RELATED APPLICATIONS

This application is a U.S. National Stage Application of International Patent Application No. PCT/EP2019/064031 filed on May 29, 2019, which claims priority to European Patent Application No. 18174886.4 filed on May 29, 2018, both of which are incorporated herein by reference in their entirety.

The present invention relates to a building panel adapted to be mounted at a ceiling or wall of a room so that a framework of the building panel has a room-facing side and a building-facing side, wherein the framework includes a peripheral frame formed by frame profile members and a plate member extending between the frame profile members, wherein a textile is extended over the room-facing side of the framework between the frame profile members, and wherein each edge of the textile is attached to a corresponding frame profile member by means of a spring-biased tensioning mechanism.

WO 2005/073482 A2 discloses a system of building panels for suspended ceilings. Each building panel includes a frame composed by extruded profile members, and a room-facing side of the building panel is formed by a textile suspended between the profile members. Different tensioning systems are disclosed whereby the textile may be stretched evenly over the opening of the frame and thereby form a smooth flat surface visible from the room. It is also known to mount a metal plate to the profile members of this kind of panel, for instance by means of riveting, so that the metal plate extends between the profile members behind the textile. The metal plate may be perforated and may be mounted for acoustical reasons or it may be mounted in order to use the building panel as a magnetic pin up board.

WO 2004/106663 A1 discloses various embodiments of wall-covering modules and systems comprising such modules. The modules according to a first embodiment are formed as elongated hollow bodies comprising a planar front face and a rearward closure panel, thereby forming a closed cavity which can be used for instance for acoustical purposes. The cavity can be closed at either longitudinal end. The front face may be provided with a textile covering fixed in attachment portions having the form of circular recesses. The module according to the first embodiment can for instance be formed as a metal profile or an extruded plastic profile. The second embodiment comprises a separate front face and two separate opposing lateral edge portions and therefore has the inherent advantages of providing a module which is flexible with respect to the width of the module without it being necessary to produce a range of complete modules of different width, as it would have been required in connection with the first embodiment.

DE 26 59 722 A1 and DE 1 008 470 B disclose examples of a ceiling or wall panel in which a fabric or textile is extended over a frame composed by profiles formed by pieces of bent metal plate.

U.S. Pat. No. 3,379,237 discloses a frame construction for screens mounted at a window opening on the outside of a building. The edges of the screen are attached to corresponding frame profile members in that each frame profile member is formed as a spring-biased clamping mechanism itself. Each frame profile member has a tube-formed cross-section formed by a folded plate member. When closed to form the tube-formed cross-section, opposed edges of the plate member is elastically pressed against each other and thereby grips on each side of the screen.

The object of the present invention is to provide a building panel which is simpler to manufacture than known panels.

In view of this object, at least some of the frame profile members are formed by bending a corresponding edge area of a metal plate forming the plate member, thereby forming said frame profile members in one piece with the plate member, said edge area of the metal plate forms a rounded outer edge connecting a room-facing side of the plate member with a building-facing side of the corresponding frame profile member, the building-facing side of the corresponding frame profile member includes a first oblique plate section of the metal plate forming an acute angle with the plate member and having a first end and a second end, the first end being connected to the rounded outer edge, the textile is bent about the rounded outer edge of said profile members, and an edge element attached along the corresponding edge of the textile is adapted to slide along the first oblique plate section of the metal plate and is spring-biased in the direction of the second end of the first oblique plate section of the metal plate.

Thereby, the entire framework of the building panel may be formed by bending one sheet of metal plate, thereby reducing the number of assembly operations vastly as compared to known building panels.

In a structurally particularly advantageous embodiment, the first end of the first oblique plate section of the metal plate is connected to the rounded outer edge by means of a first intermediate plate section extending at an angle in relation to the first oblique plate section. Thereby, suitable space may be provided for the spring-biased tensioning mechanism between the first oblique plate section and the textile. Furthermore, a more rigid framework may be achieved as a result of further bending the metal plate.

Preferably, the first intermediate plate section extends at least substantially in parallel to the plate member.

In an embodiment, the first intermediate plate section and the plate member tapers in relation to each other in the direction of the rounded outer edge or the first intermediate plate section extends in parallel to the plate member. Thereby, connection of adjacent first and second frame profile members formed by bending corresponding edge areas of the metal plate forming the plate member may be facilitated in that a corner piece may be inserted by sliding from the inside of the panel when the frame profile members have been formed by bending.

In an embodiment, adjacent first and second frame profile members formed by bending corresponding edge areas of the metal plate forming the plate member are mutually connected by means of a corner piece fitting between the plate member and the respective first intermediate plate sections of the first and second frame profile members, said corner piece preferably being a massive element and preferably being produced by moulding. Thereby, a rigid connection may be formed between adjacent first and second frame profile members formed by bending corresponding edge areas of the metal plate forming the plate member, and thereby a more rigid building panel may be obtained.

In an embodiment, the edge element is spring-biased by means of a number of spring elements extending through corresponding cut-outs in said edge area of the metal plate. Thereby, a simple and effective spring-biased tensioning mechanism may be obtained in that the spring elements may easily be fixed in relation to said edge area of the metal plate by inserting them through the corresponding cut-outs.

In an embodiment, the edge element is spring-biased by means of a number of spring elements extending through corresponding cut-outs in the first intermediate plate section of the metal plate. Thereby, a simple and effective spring-biased tensioning mechanism may be obtained in that the spring elements may easily be fixed in relation to the edge area of the metal plate by inserting them through the corresponding cut-outs in the first intermediate plate section of the metal plate. Furthermore, suitable space may be provided for the spring elements between the first oblique plate section, the first intermediate plate section and the textile.

In an embodiment, the building-facing side of the corresponding frame profile member includes a second oblique plate section of the metal plate extending between a first end and a second end thereof, the first end of the second oblique plate section is connected to the second end of the first oblique plate section, a channel is formed between the first oblique plate section and the second oblique plate section, and the edge element attached along the corresponding edge of the textile is adapted to slide into said channel. Thereby, the edge element may suitably be guided in said channel between the first oblique plate section and the second oblique plate section, and thereby, a reliable tensioning mechanism may in a simple manner be integrated into the frame profile members formed by bending a metal plate.

Preferably, the second oblique plate section is at least substantially parallel to the first oblique plate section. Thereby, the edge element may be guided in the channel between the first oblique plate section and the second oblique plate section with reduced play.

In an embodiment, the first end of the second oblique plate section of the metal plate is connected to the second end of the first oblique plate section by means of a second intermediate plate section. Thereby, an appropriate building-facing side of the frame profile members may be formed which may be used for mounting connection purposes. Furthermore, the rigidity of the frame profile members may be increased, thereby resulting in a more rigid building panel.

Preferably, the second intermediate plate section extends at least substantially in parallel to the plate member. Thereby, connection between the second intermediate plate section and elements for support and/or mounting of the building panel may be facilitated.

In an embodiment, adjacent first and second frame profile members formed by bending corresponding edge areas of the metal plate forming the plate member are mutually connected by means of a corner bracket, the corner bracket has a first flange extending through a cut-out in the first oblique plate section of the first frame profile member and a second flange extending through a cut-out in the first oblique plate section of the second frame profile member. Thereby, the rigidity of the peripheral frame formed by the frame profile members may be increased. Thereby, a more rigid building panel may be obtained.

In an embodiment, the first and second flanges of the corner bracket abut and are fixed to a plate section of the metal plate being connected to the second end of the first oblique plate section and extending at least substantially in parallel to the plate member. Thereby, the rigidity of the peripheral frame formed by the frame profile members may be even more increased. Thereby, an even more rigid building panel may be obtained.

In an embodiment, opposed first and second frame profile members formed by bending corresponding edge areas of the metal plate forming the plate member are mutually connected by means of a crossbar provided with a first and a second connection bracket at its respective ends, and each connection bracket has a flange extending through a cut-out in the first oblique plate section of the respective frame profile member. Thereby, the rigidity of the peripheral frame formed by the frame profile members may be even more increased. Thereby, an even more rigid building panel may be obtained.

In an embodiment, the respective flanges of the connection brackets abut and are fixed to a plate section of the metal plate being connected to the second end of the first oblique plate section and extending at least substantially in parallel to the plate member. Thereby, the rigidity of the peripheral frame formed by the frame profile members may be even more increased. Thereby, an even more rigid building panel may be obtained.

The present invention further relates to a method of manufacturing a building panel adapted to be mounted at a ceiling or wall of a room so that a framework of the building panel has a room-facing side and a building-facing side, the framework including a peripheral frame formed by frame profile members and a plate member extending between the frame profile members, whereby a textile is extended over the room-facing side of the framework between the frame profile members, and whereby each edge of the textile is attached to a corresponding frame profile member by means of a spring-biased tensioning mechanism.

The method is characterised by bending at least some edge areas of a metal plate forming the plate member, thereby forming corresponding frame profile members in one piece with the plate member, by forming, in said respective edge areas of the metal plate, a rounded outer edge connecting a room-facing side of the plate member with a building-facing side of the corresponding frame profile member, so that the building-facing side of the corresponding frame profile member includes a first oblique plate section of the metal plate forming an acute angle with the plate member and having a first end and a second end, the first end being connected to the rounded outer edge, by bending the textile about the rounded outer edge of said profile members, by adapting an edge element attached along the corresponding edge of the textile to slide along the first oblique plate section of the metal plate, and by spring-biasing the edge element in the direction of the second end of the first oblique plate section of the metal plate. Thereby, the above described features may be obtained.

In an embodiment, a second oblique plate section of the metal plate extending between a first end and a second end thereof and preferably being at least substantially parallel to the first oblique plate section is formed by bending said edge areas of the metal plate so that the first end of the second oblique plate section is connected to the second end of the first oblique plate section, a channel is formed between the first oblique plate section and the second oblique plate section, and an edge element attached along the corresponding edge of the textile is adapted to slide into said channel. Thereby, the above described features may be obtained.

The invention will now be explained in more detail below by means of examples of embodiments with reference to the very schematic drawing, in which FIG. 1 illustrates the building panel according to the invention, seen from the building-facing side, wherein the textile and associated tensioning mechanism has not been attached;

Figure 1:
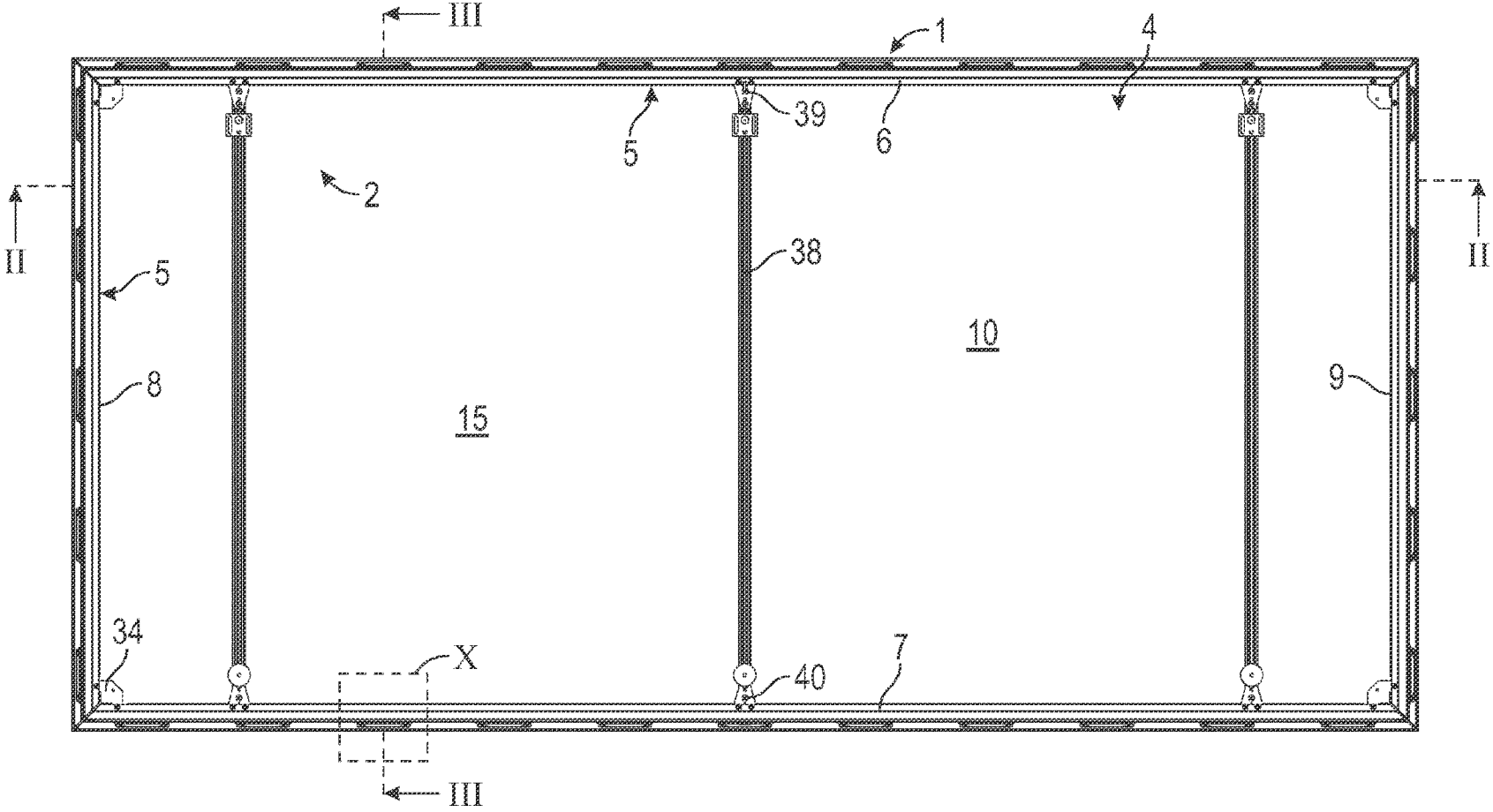
Figure 2:
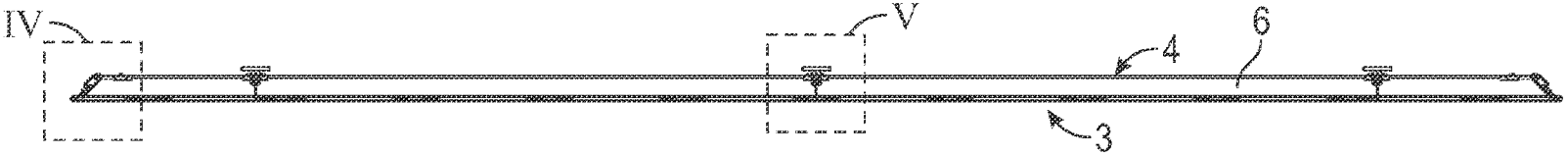
FIG. 2 is a cross-section along the line II-II in FIG. 1.
Figure 3:
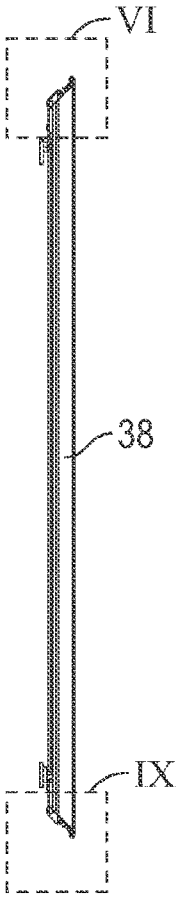
FIG. 3 is a cross-section along the line III-III in FIG. 1.

FIG. 1 shows a top view of a building panel 1 according to the present invention adapted to be mounted at a ceiling of a room so that a framework 2 of the building panel has a room-facing side 3 and a building-facing side 4. In the embodiment illustrated, the building panel 1 is a ceiling panel, the room-facing side 3 faces downwards and the building-facing side 4 is adapted to face a not shown ceiling of a room, as indicated in FIG. 2.

The framework 2 includes a peripheral frame 5 formed by four frame profile members 6, 7, 8, 9 and a plate member 10 extending between the frame profile members. In other embodiments, the peripheral frame 5 may be formed by any other suitable number of frame profile members, such as three, five, six or more. A textile 11 is extended over the room-facing side 3 of the framework 2 between the frame profile members 6, 7, 8, 9, and each edge 12 of the textile 11 is attached to a corresponding frame profile member 6, 7, 8, 9 by means of a spring-biased tensioning mechanism 13, as illustrated in FIG. 7.

Figure 13:
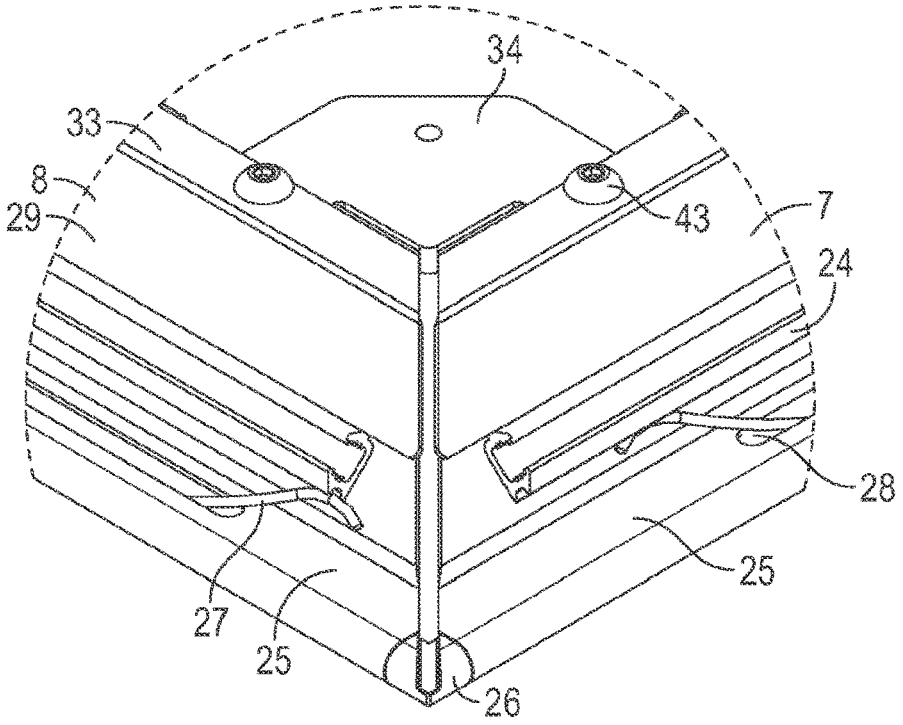
FIG. 13 illustrates the detail XIII of FIG. 12 on a larger scale.
Figure 14:
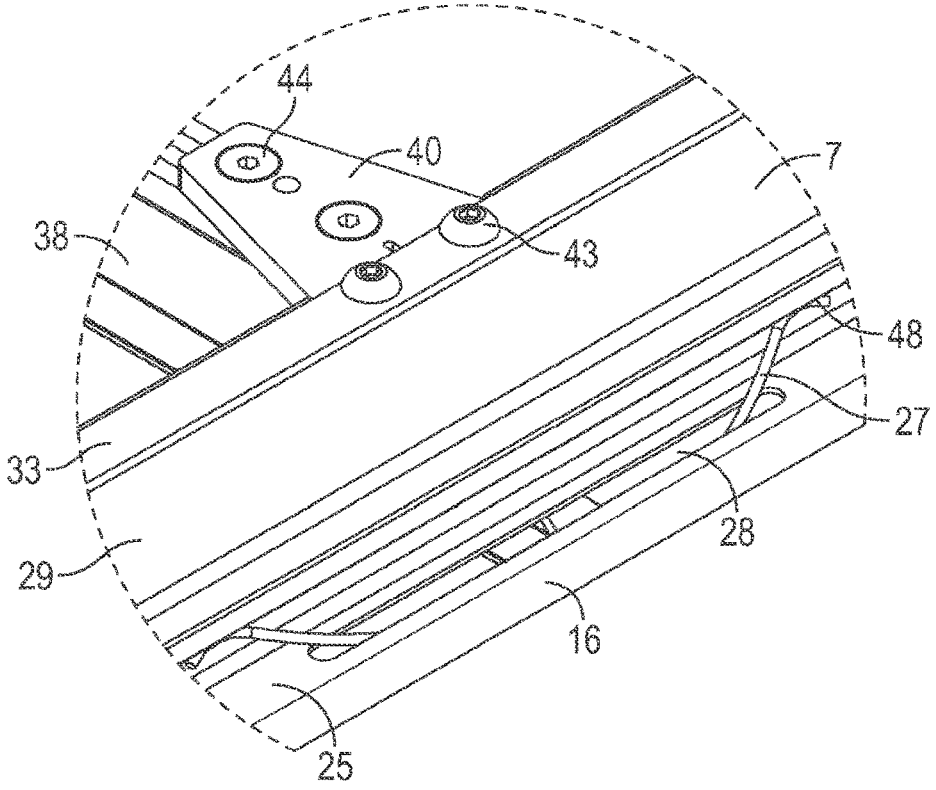
FIG. 14 illustrates the detail XIV of FIG. 12 on a larger scale.
Figure 15:
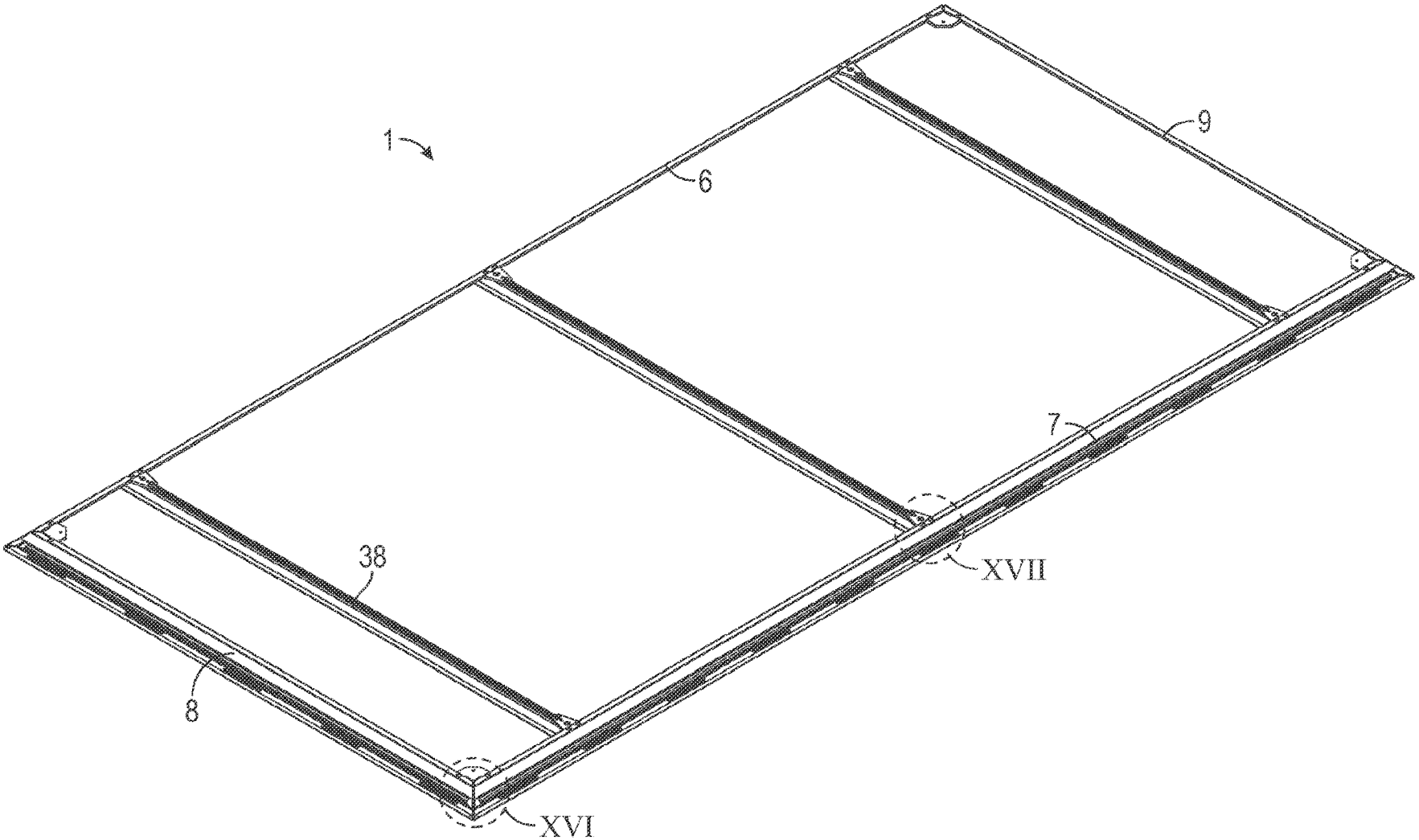
FIG. 15 is a perspective view corresponding to the view of FIG. 1 of the building panel according to the invention.
Figure 22:
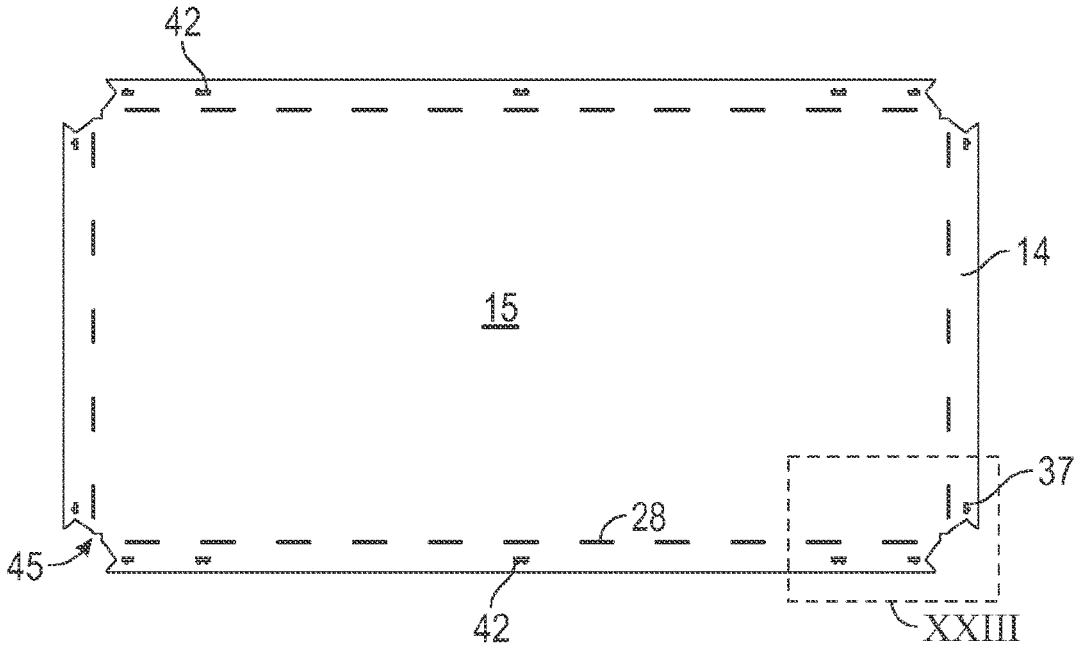
FIG. 22 illustrates a top view of a metal plate which has been laser cut in a form suitable for bending into a framework for the building panel illustrated in FIG. 1.
Figure 23:
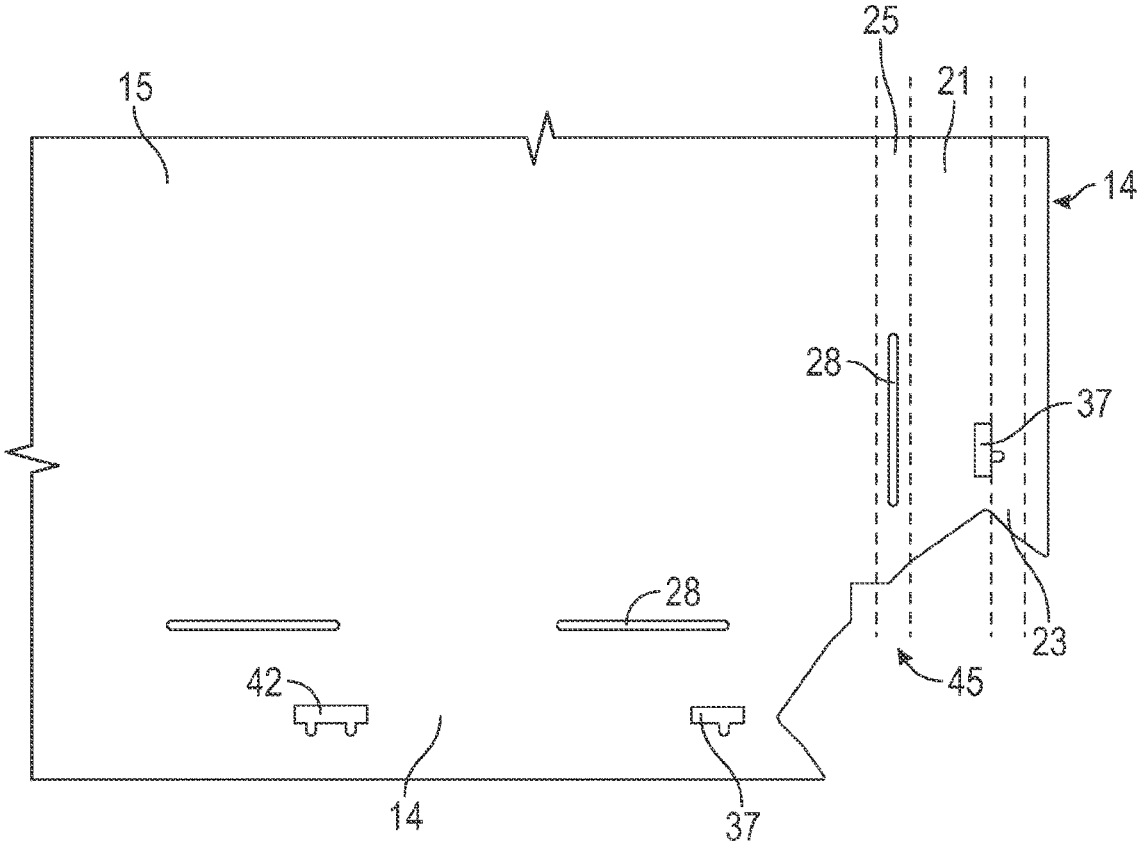
FIG. 23 illustrates the detail XXIII of FIG. 22 on a larger scale.

In the embodiment illustrated, all four frame profile members 6, 7, 8, 9 are formed by bending a corresponding edge area 14 of a metal plate 15 forming the plate member 10, thereby forming said frame profile members 6, 7, 8, 9 in one piece with the plate member 10. A flat metal plate 15 laser cut or punched out with a suitable circumference for forming the four frame profile members 6, 7, 8, 9 is illustrated in FIGS. 22 and 23. As seen, suitable corner cut-outs 45 are formed in each corner in the metal plate 15, thereby allowing bending the edge areas 14 of the plate into frame profile members 6, 7, 8, 9 in such a way that the resulting frame profile members 6, 7, 8, 9 may meet at the corners more or less in a mitre joint. The corner cut-outs 45 are also formed so to allow insertion of corner pieces 26 at the corners, as seen in FIG. 13, and as it will be further described below. Although not illustrated, the plate member 10 may be perforated or provided with one ore more additional cut-outs in any other suitable way, for instance in order to allow sound and/or air to pass through such perforations or cut-outs. As an example, a central cut-out may be formed extending to a certain distance from the frame profile members 6, 7, 8, 9, so that still enough of the plate member 10 remains in order to provide the required stiffness to the framework 2 of the building panel 1. For instance, such a central cut-out may form a remaining part of the plate member 10 measuring between a few centimetres and several centimetres from the respective frame profile members 6, 7, 8, 9.

Figure 6:
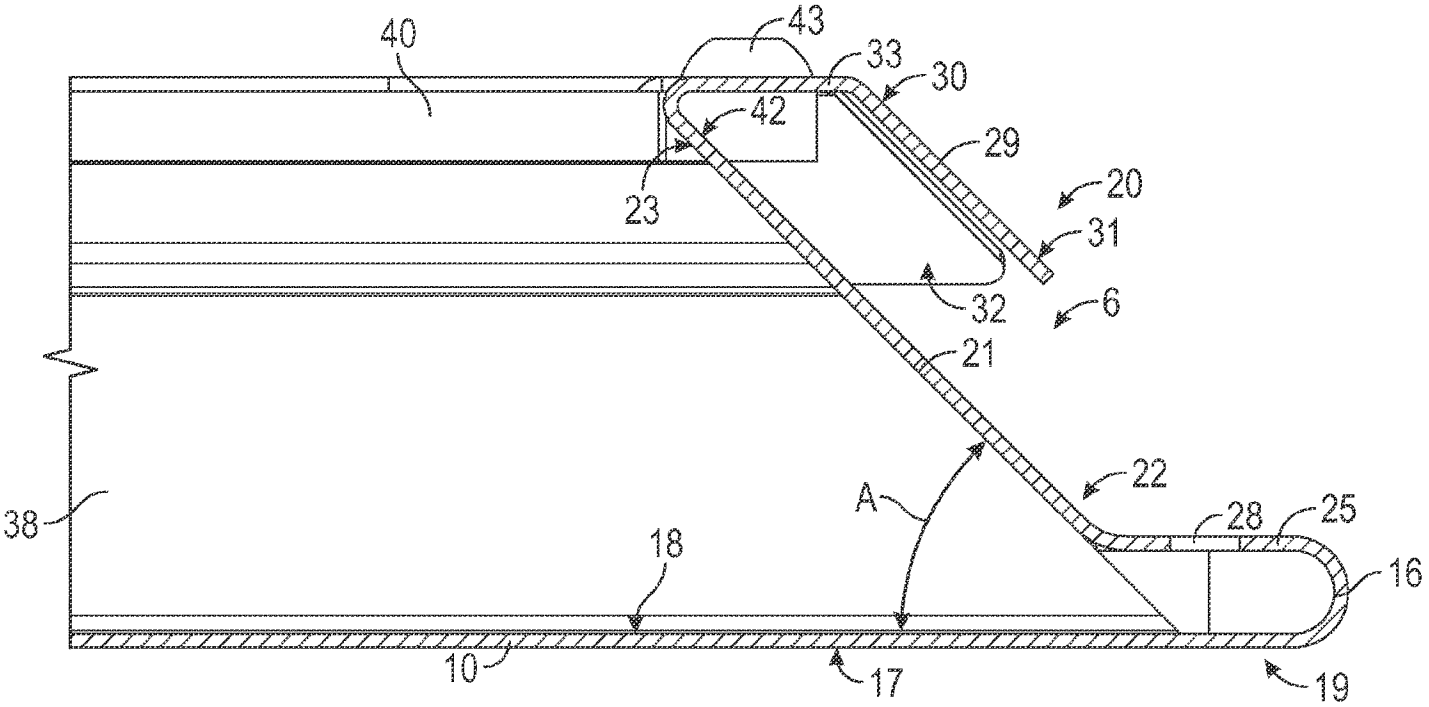
FIG. 6 illustrates the detail VI of FIG. 3 on a larger scale.
Figure 7:
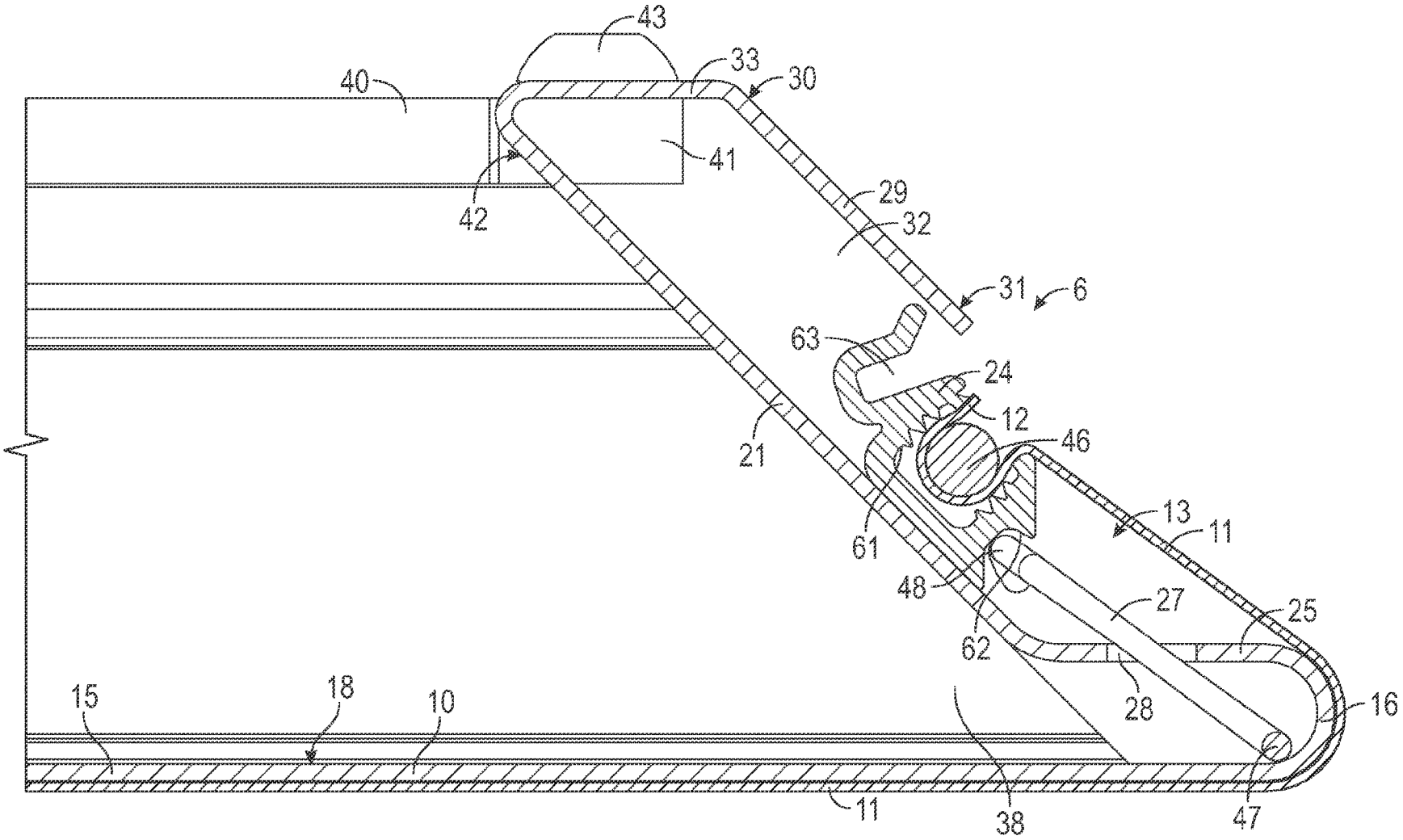
FIG. 7 is a view corresponding to that of FIG. 6, illustrating the detail VI of FIG. 3 on a larger scale, wherein, however, the textile and the associated spring-biased tensioning mechanism has been mounted.
Figure 8:
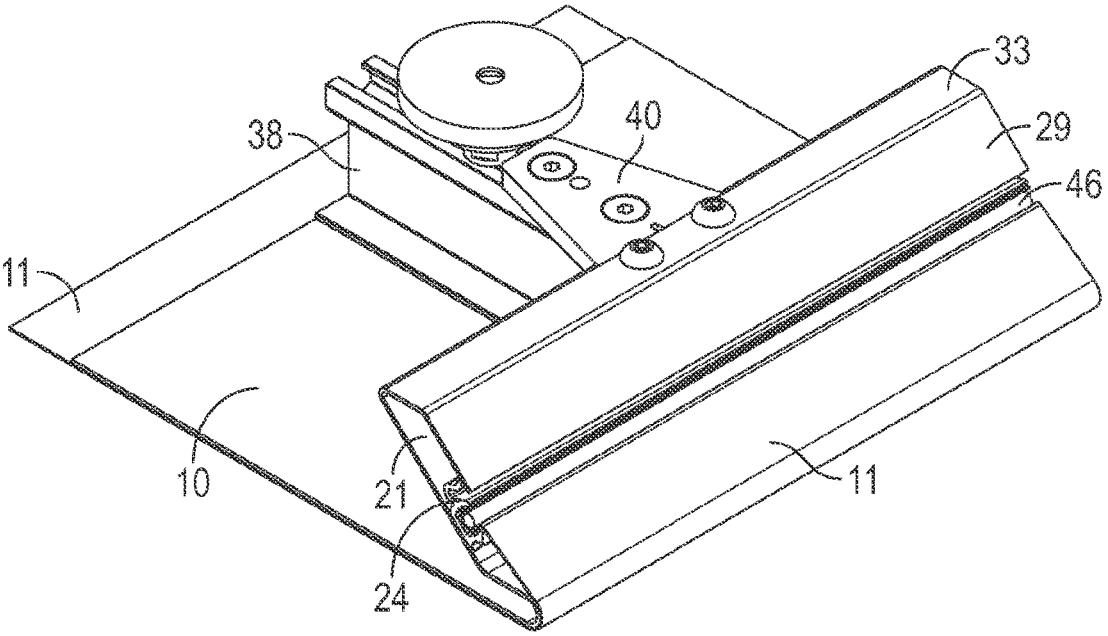
FIG. 8 is a perspective view of a cut-out part of the building panel of FIG. 1, the left side of said cut-out part forming the cross-section of FIG. 7, wherein the textile and the associated spring-biased tensioning mechanism has been mounted.

As seen in FIGS. 6 and 7, said edge area 14 of the metal plate 15 forms a rounded outer edge 16 connecting a room-facing side 17 of the plate member 10 with a building-facing side 20 of the corresponding frame profile member 6, 7, 8, 9. The building-facing side 20 of the corresponding frame profile member 6, 7, 8, 9 includes a first oblique plate section 21 of the metal plate 15 forming an acute angle A with the plate member 10 and having a first end 22 and a second end 23. The acute angle A may have any suitable size, such as for instance 45 degrees, and any angle between 0 and 90 degrees may work, depending on the installation. However, generally, it is preferred that the building-facing side 20 of the corresponding frame profile member 6, 7, 8, 9 is little visible from the room in which the building panel 1 is installed, and therefore an acute angle A of less than about 60 degrees may be preferred. The first end 22 of the first oblique plate section 21 is connected to the rounded outer edge 16 by means of a first intermediate plate section 25 extending substantially in parallel to the plate member 10.

The textile 11 is bent about the rounded outer edge 16 of said profile members 6, 7, 8, 9, and an edge element 24 is attached along the corresponding edge 12 of the textile 11. As seen in particular in FIG. 16, the edge element 24 has the form of a longitudinal profile. This attachment is achieved by pressing the edge 12 of the textile 11 into a toothed groove 61 of the edge element 24 by means of a coil spring 46 having a diameter in its relaxed state being slightly larger than a cross-section of the toothed groove 61, thereby pinching the edge 12 of the textile 11 between the coil spring 46 and opposed toothed walls of the toothed groove 61.

The edge element 24 is adapted to slide along the first oblique plate section 21 of the metal plate 15 and is spring-biased in the direction of the second end 23 of the first oblique plate section 21 of the metal plate 15 by means of a number of spring elements 27 extending through corresponding cut-outs 28 in the first intermediate plate section 25 of the metal plate 15. Thereby, the textile 11 is pretensioned between all four profile members 6, 7, 8, 9 and proper tension of the textile 11 may therefore be ensured even if for instance the framework 2 should be slightly deformed. As seen in FIG. 7, each spring element 27 has a first end 47 abutting the building-facing side 18 of the plate member 15 in the area of the transition between the plate member 10 and the rounded outer edge 16 of the frame profile member. Furthermore, each spring element 27 has a second end 48 abutting a recess 62 of the edge element 24 attached along the edge 12 of the textile 11. As seen in particular in FIG. 16, the spring element 27 is formed as an elastic hoop, whereby the first end 47 of the spring element 27 is formed in the middle of the hook forming the spring element 27, and whereby the second end 48 of the spring element 27 is formed by both ends of the hook forming the spring element 27. Of course, other suitable configurations of the spring element 27 are possible.

Figure 9:
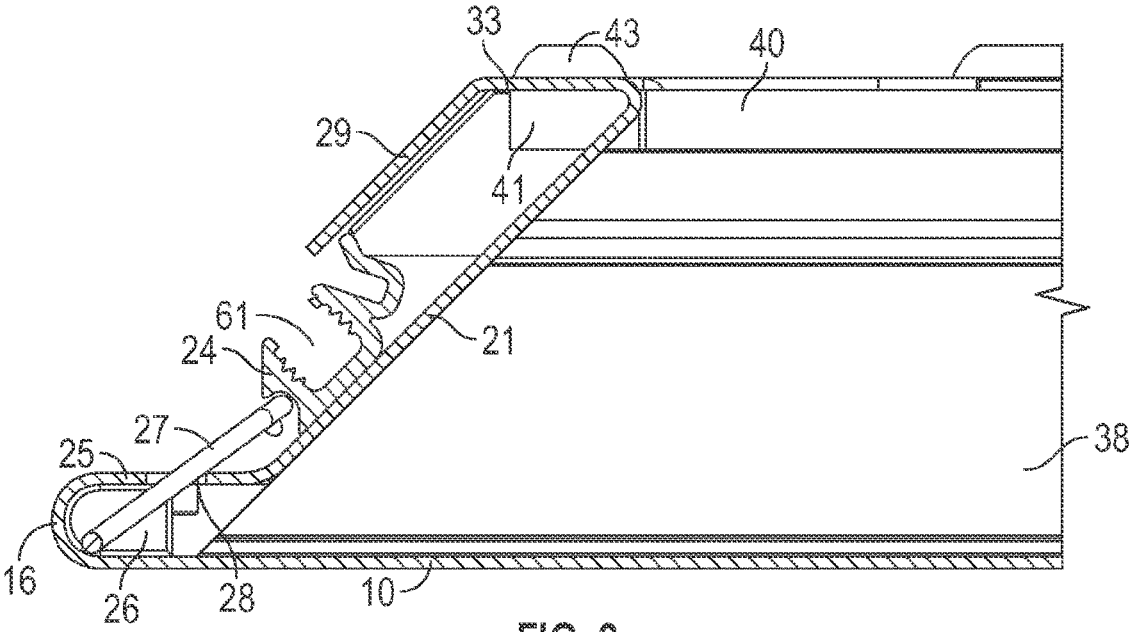
FIG. 9 illustrates the detail IX of FIG. 3 on a larger scale, wherein, however, the spring-biased tensioning mechanism has been mounted.
Figure 10:
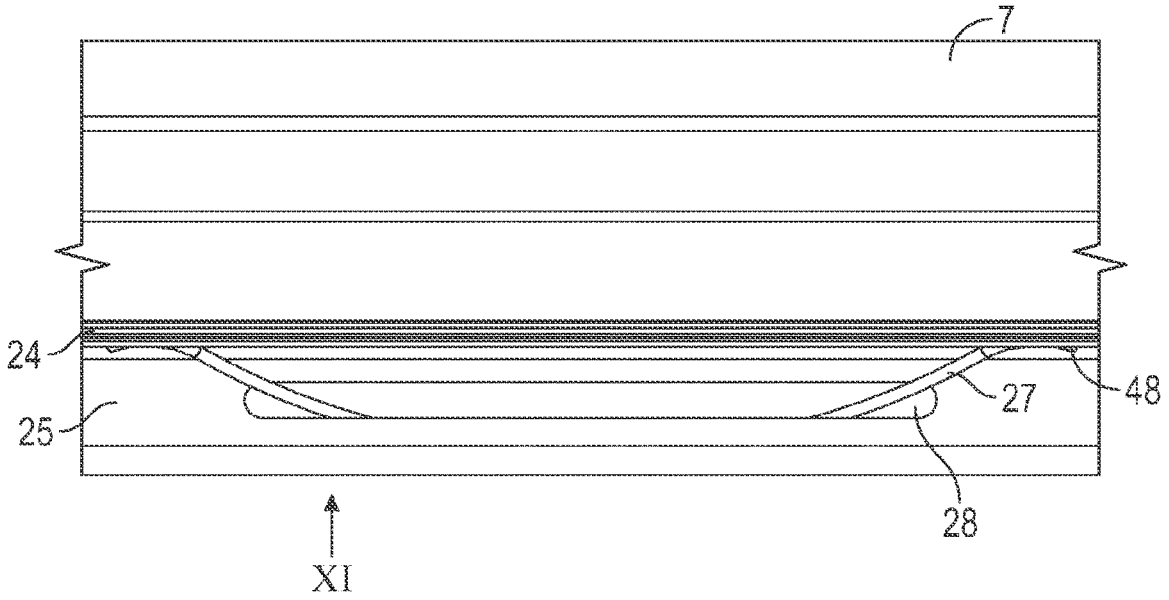
FIG. 10 illustrates the detail X of FIG. 1 on a larger scale, wherein, however, the spring-biased tensioning mechanism has been mounted.
Figure 11:
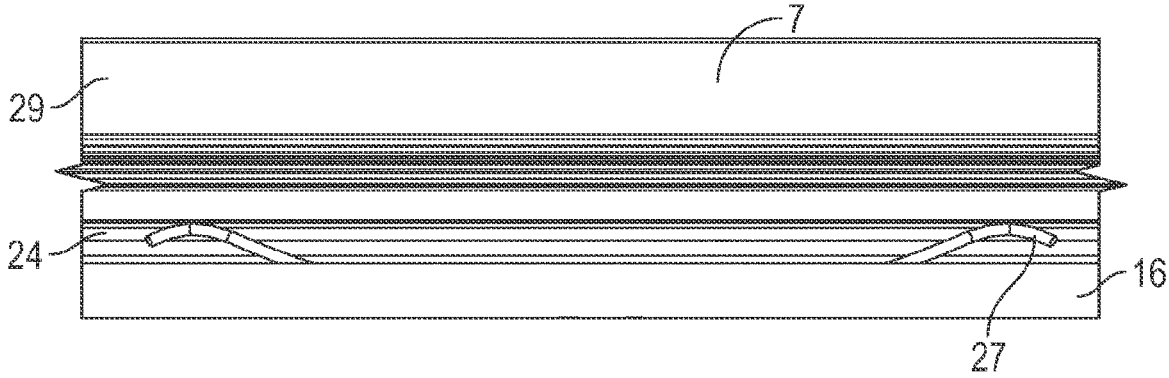
FIG. 11 illustrates the detail of FIG. 10 seen from the side as illustrated by the arrow XI.
Figure 12:
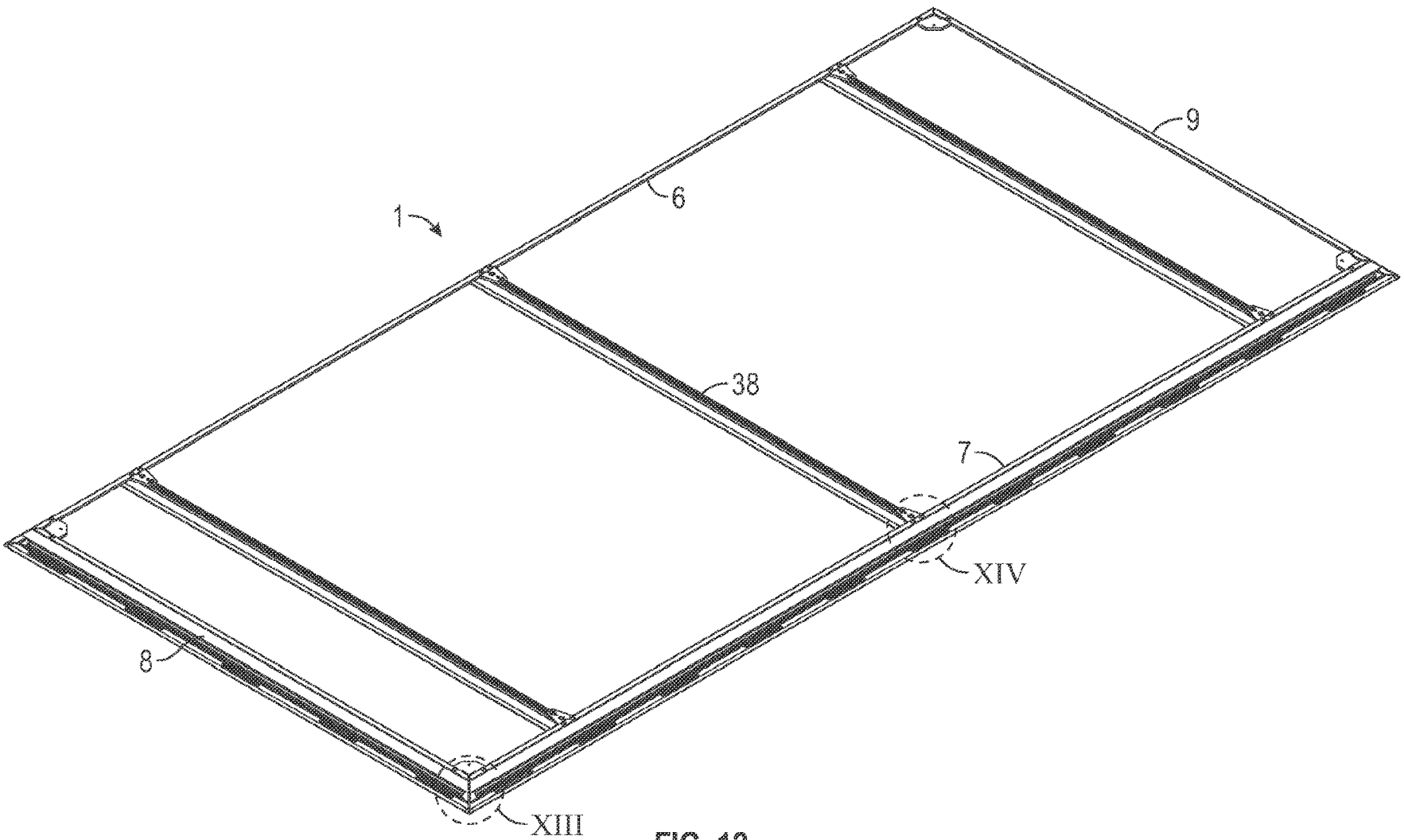
FIG. 12 is a perspective view of the building panel of FIG. 1 seen from the building-facing side, wherein, however, the spring-biased tensioning mechanism has been mounted.
Figure 16:
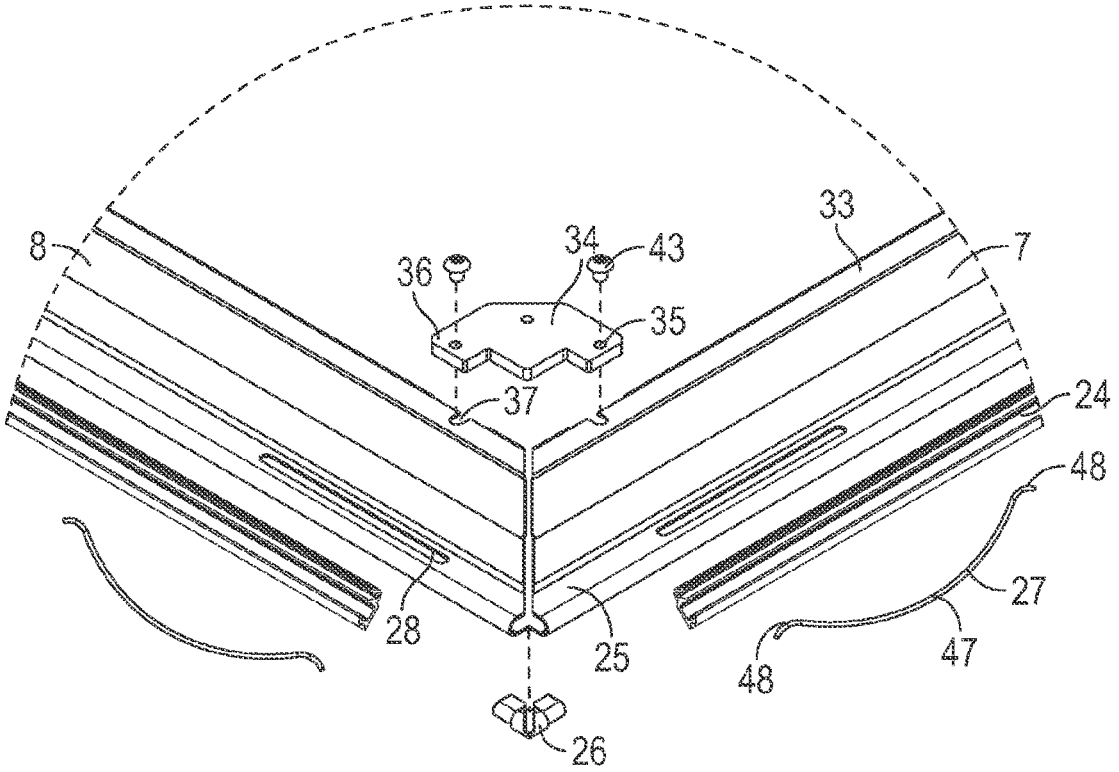
FIG. 16 illustrates an exploded view of the detail XVI of FIG. 15 on a larger scale.
Figure 17:
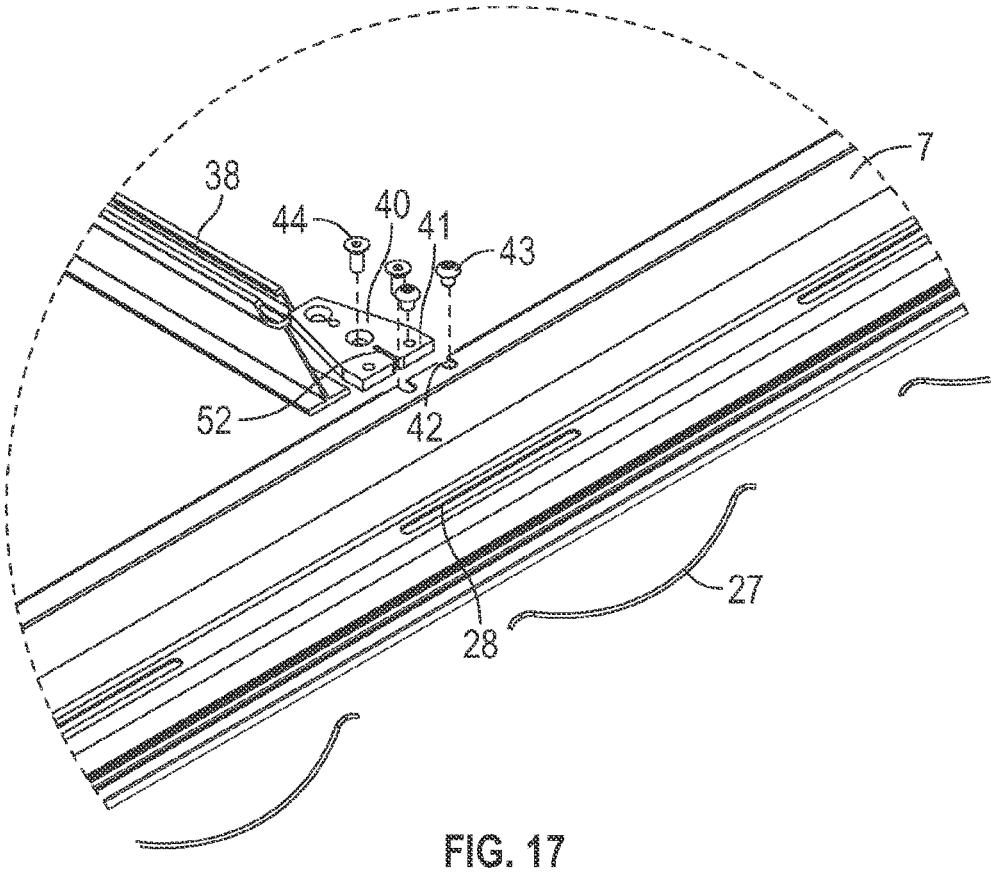
FIG. 17 illustrates an exploded view of the detail XVII of FIG. 15 on a larger scale.

As illustrated in FIGS. 9, 13 and 16, adjacent first and second frame profile members 6, 7, 8, 9 are mutually connected by means of the corner piece 26 fitting between the plate member 10 and the respective first intermediate plate sections 25 of the first and second frame profile members 7, 8. The corner piece 26 illustrated is a massive element and may for instance be a moulded metal element or an injection moulded plastic element. In the embodiment illustrated, in which the first intermediate plate section 25 extends in parallel to the plate member 10, the corner piece 26 may be inserted by sliding it in place from the inside of the building panel 1 when the frame profile members 6, 7, 8, 9 have been formed by bending. In another embodiment, the first intermediate plate section 25 and the plate member 10 may taper in relation to each other in the direction of the rounded outer edge 16. In this embodiment, the corner piece 26 may also be inserted by sliding it in place from the inside of the building panel 1.

As further seen in FIGS. 6 and 7, the building-facing side 20 of the frame profile member 6, 7, 8, 9 includes a second oblique plate section 29 of the metal plate 15 extending between a first end 30 and a second end 31 thereof and being substantially parallel to the first oblique plate section 21. The first end 30 of the second oblique plate section 29 is connected to the second end 23 of the first oblique plate section 21 by means of a second intermediate plate section 33 extending substantially in parallel to the plate member 10. Thereby, a channel 32 is formed between the first oblique plate section 21 and the second oblique plate section 29. The edge element 24 attached along the corresponding edge 12 of the textile 11 is adapted to slide into said channel 32 when the textile 11 is tensioned by means of the spring elements 27. As seen, the edge element 24 has an additional groove 63 in which a not shown tool may be inserted in order to temporarily fixate the edge element 24 in relation to the second end 31 of the second oblique plate section 29 when attaching the edge 12 of the textile 11 to the edge element 24 or when detaching the edge 12 of the textile 11.

Figure 4:
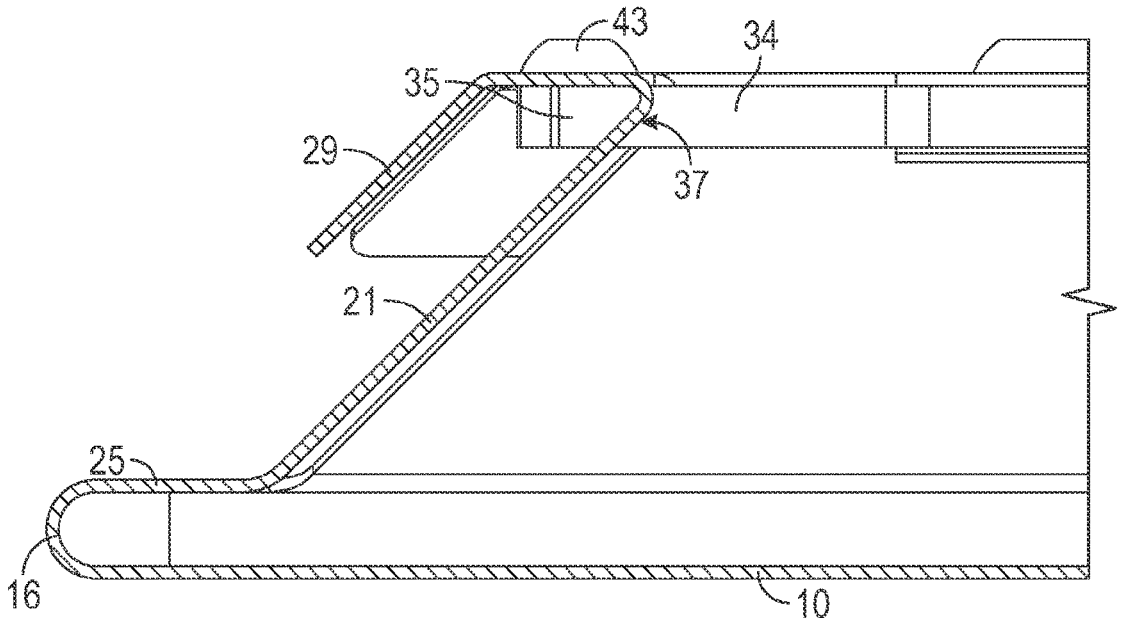
FIG. 4 illustrates the detail IV of FIG. 2 on a larger scale.
Figure 5:
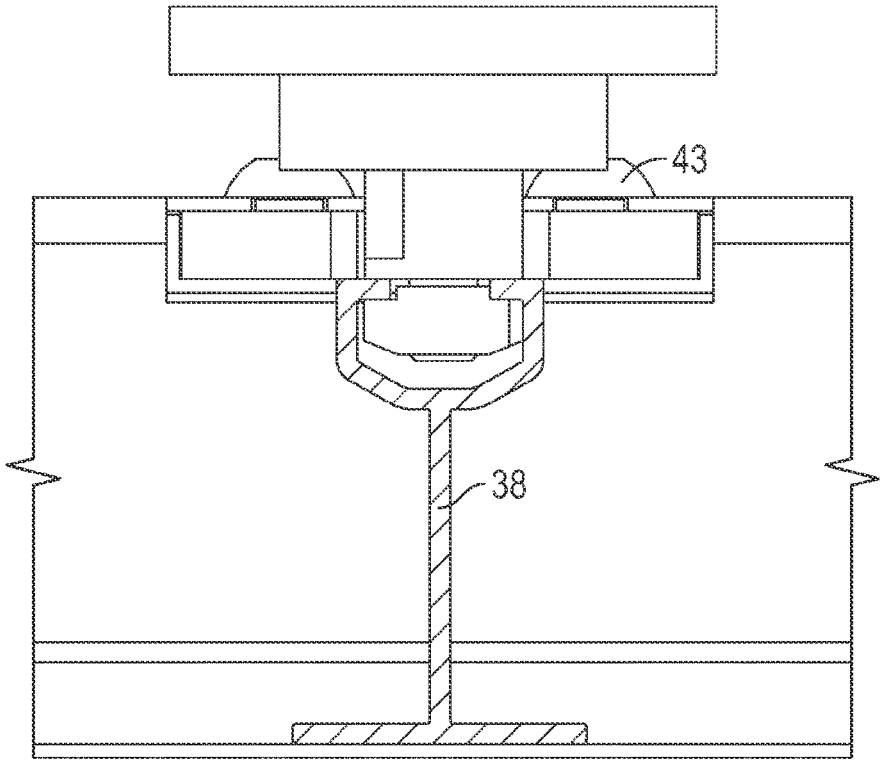
FIG. 5 illustrates the detail V of FIG. 2 on a larger scale.

As illustrated in FIGS. 4, 13 and 16, furthermore, adjacent first and second frame profile members 7, 8 are mutually connected by means of a corner bracket 34. The corner bracket 34 has a first flange 35 extending through a cut-out 37 in the first oblique plate section 21 of the first frame profile member 7 and a second flange 36 extending through a cut-out 37 in the first oblique plate section 21 of the second frame profile member 8. The cut-out 37 is indicated in FIG. 4 and is in particular visible in FIGS. 22 and 23. As further seen in the figures, the first and second flanges 35, 36 of the corner bracket 34 abut and are fixed to the plate section 33 connecting the first oblique plate section 21 and the second oblique plate section 29. As seen, the first and second flanges 35, 36 of the corner bracket 34 abut the lower side of the plate section 33, as seen in the figures, and are fixed to the plate section 33 by means of screws 43 inserted into threaded holes in the first and second flanges 35, 36. In general, when screws are illustrated as a possible connection means, other means may also be used, such as riveting, clinching, welding, etc.

As illustrated in FIG. 1, opposed first and second frame profile members 6, 7 along the longest sides of the building panel 1 are mutually connected by means of three crossbars 38 provided with a first and a second connection bracket 39, 40 at their respective ends. However, the crossbars 38 may be dispensed with, or any other number of crossbars 38 may be arranged. Each connection bracket 39, 40 has a flange 41 extending through a cut-out 42 in the first oblique plate section 21 of the respective frame profile member 6, 7. The cut-out 42 is indicated in FIGS. 6 and 7 and is in particular visible in FIGS. 22 and 23. The respective flanges 41 of the connection brackets 39, 40 abut and are fixed to the second intermediate plate section 33 connecting the first oblique plate section 21 and the second oblique plate section 29. As seen, the respective flanges 41 of the connection brackets 39, 40 abut the lower side of the plate section 33, as seen in the figures, and are fixed to the plate section 33 by means of screws 43 inserted into threaded holes in the respective flanges 41.

Figure 18:
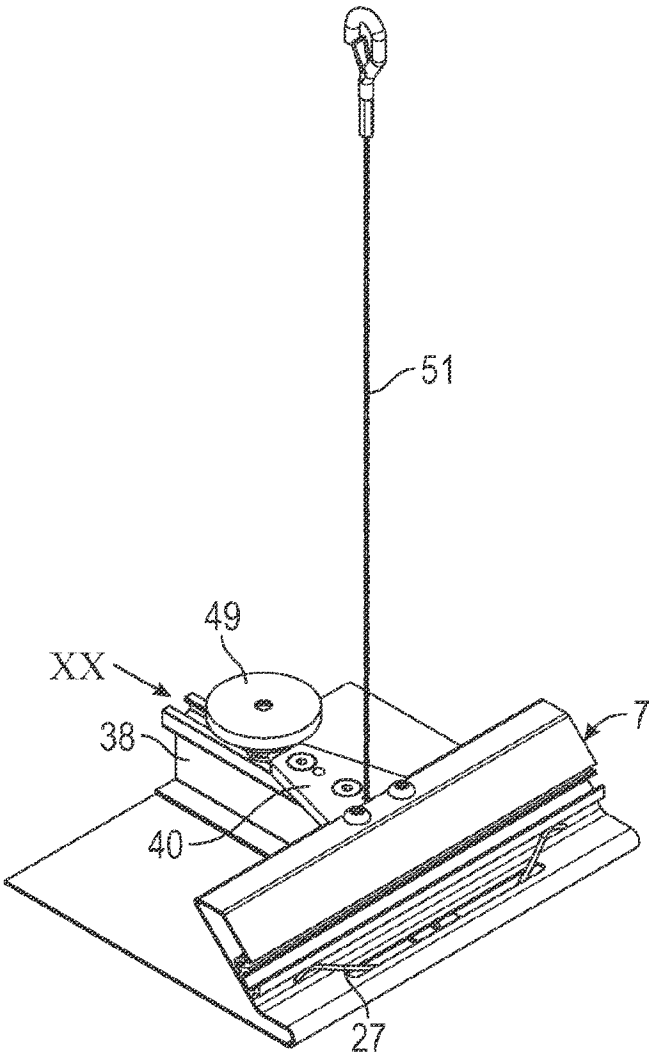
FIG. 18 is a perspective view of a cut-out part of the building panel of FIG. 1, corresponding to the detail of FIG. 8, wherein the spring-biased tensioning mechanism has been mounted, and wherein a magnetic mounting bracket and safety wire have been mounted.
Figure 20:
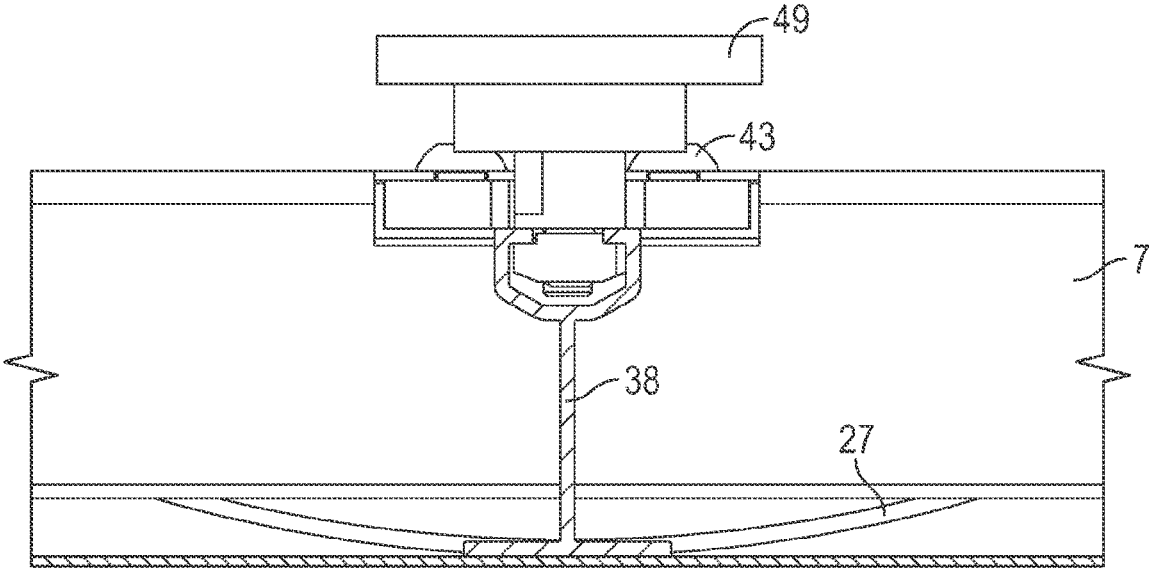
FIG. 20 illustrates a cross-section through a detail of the building panel of FIG. 1, seen in the direction of the arrow XX of FIG. 18.
Figure 21:
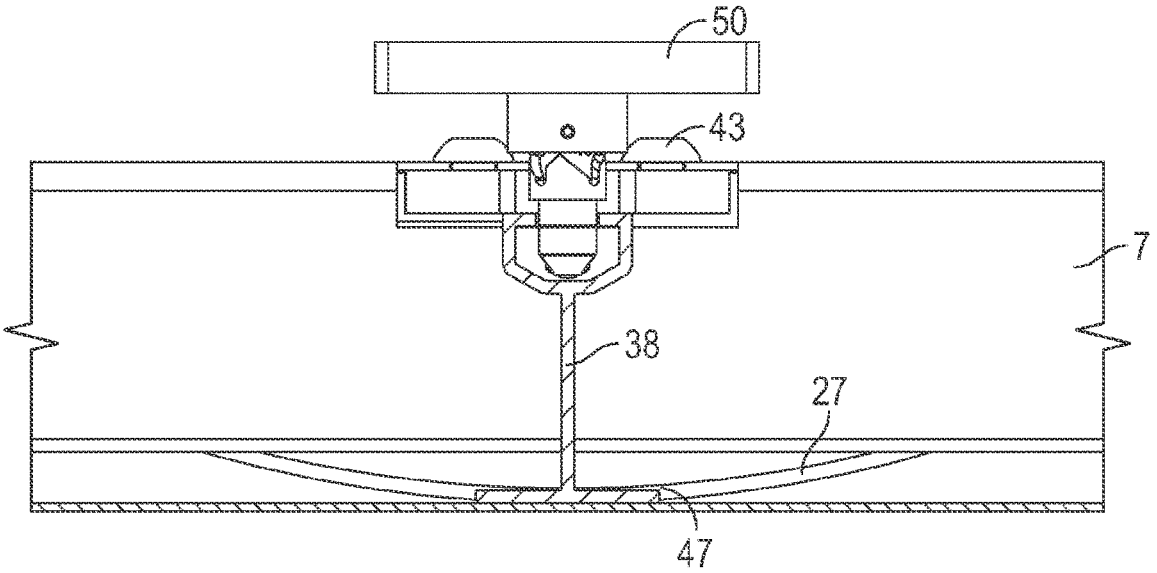
FIG. 21 illustrates a cross-section through a detail of the building panel of FIG. 1, seen in the direction of the arrow XXI of FIG. 19.

FIG. 18 illustrates a cut-out part of the building panel of FIG. 1, wherein the spring-biased tensioning mechanism has been mounted, but the textile 11 has not yet been mounted. Furthermore, a magnetic mounting bracket 49 is attached to the crossbar 38. By means of a number of magnetic mounting brackets 49, the building panel 1 may easily be attached to a not shown mounting structure arranged at the ceiling of a room in which the building panel has to be mounted. Additionally, a lower end of a safety wire 51 has been mounted in a mounting slot 52 in the flange 41 of the second connection bracket 40 of the crossbar 38. An upper end of the safety wire 51 may be attached to the mounting structure arranged at the ceiling.

Figure 19:
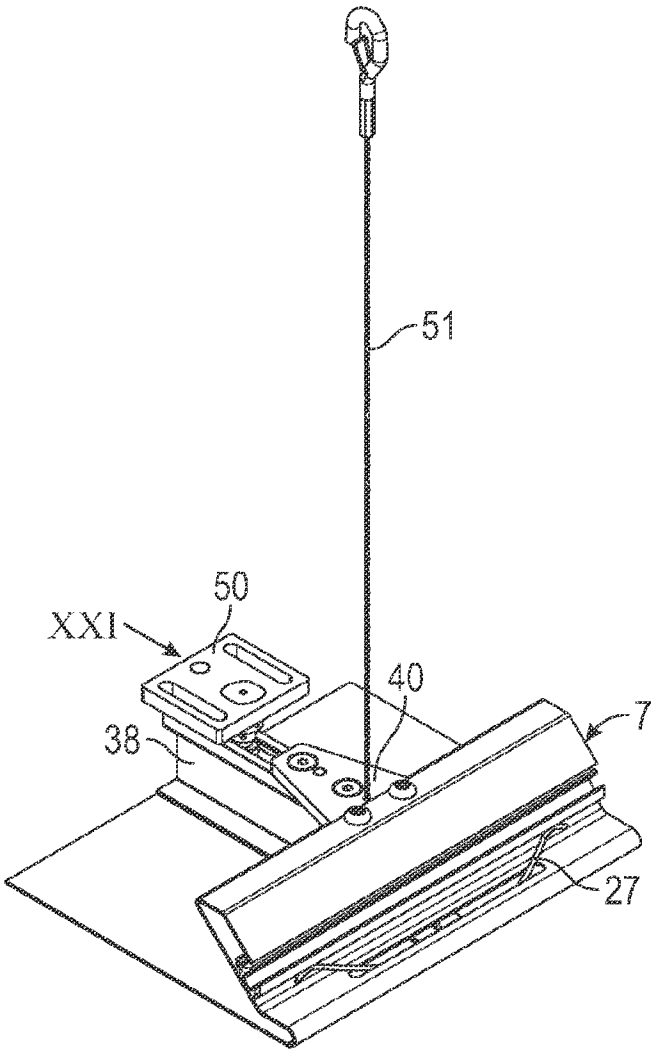
FIG. 19 is a perspective view of a cut-out part of the building panel of FIG. 1, corresponding to the detail of FIG. 8, wherein the spring-biased tensioning mechanism has been mounted, and wherein a mechanical mounting bracket and safety wire have been mounted.

FIG. 19 is a view corresponding to that of FIG. 18, but of a different embodiment, in which a mechanical mounting bracket 50 is attached to the crossbar 38. By means of a number of mechanical mounting brackets 50, the building panel 1 may easily be attached to a not shown mounting structure arranged at the ceiling of a room in which the building panel has to be mounted. In the embodiment illustrated, the mechanical mounting bracket 50 is a so-called push latch mechanism disclosed in international patent application PCT/182016/056380. Any other suitable mounting brackets may be employed. Additionally, a safety wire 51 has been mounted as in FIG. 18.

Figure 24:
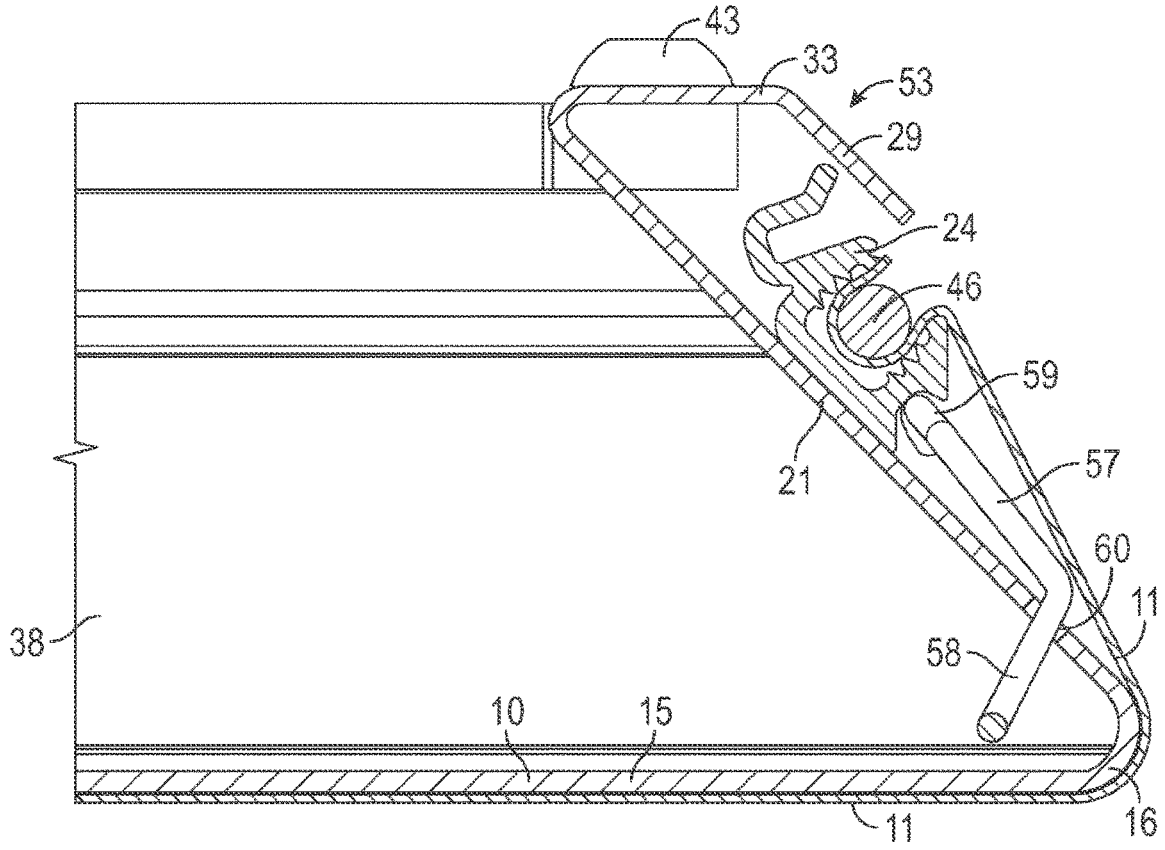
FIGS. 24 and 25 illustrate cross-sectional views corresponding to the view of FIG. 7 of alternative embodiments of the building panel according to the invention.

FIG. 24 illustrates an alternative embodiment of the building panel according to the invention. As discussed above, in the embodiment illustrated in FIG. 7, the first oblique plate section 21 of the metal plate 15 is connected to the rounded outer edge 16 of the frame profile member by means of the first intermediate plate section 25. In the alternative embodiment illustrated in FIG. 24, however, the first intermediate plate section 25 has been dispensed with so that the first oblique plate section 21 of the metal plate 15 is directly connected to the rounded outer edge 16 of the frame profile member. In order to arrange the spring-biased tensioning mechanism 13, an alternative spring element 57 has been arranged so that it extends through and abuts in a cut-out 60 in the first oblique plate section 21 of the metal plate 15. A first end 58 of the spring element 57 abuts the building-facing side 18 of the plate member 15 in the area of the plate member 10. Furthermore, a second end 59 of the spring element 57 abuts a recess 62 of the edge element 24 attached along the edge 12 of the textile 11. The part of the spring element 57 extending from the cut-out 60 to the second end 59 has been bent appropriately in order to arrange the spring element 57 in the room between the first oblique plate section 21, the textile 11 and the edge element 24, and in order to ensure proper support for the spring element 57 in relation to the plate member 15.

Figure 25:
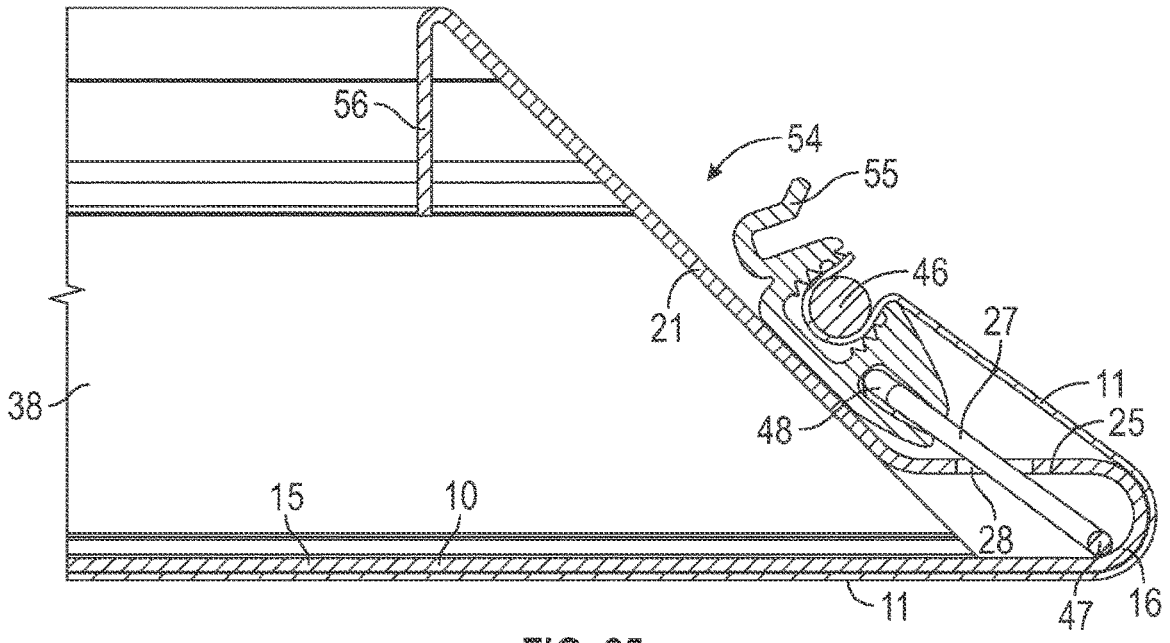

FIG. 25 illustrates a further alternative embodiment of the building panel according to the invention. In this alternative embodiment, the second intermediate plate section 33 and the second oblique plate section 29 of the embodiment illustrated in FIG. 7 have been dispensed with. Instead, the second end 42 of the first oblique plate section 21 continues in a bent down portion in the form of a, in the illustration vertical, plate section 56, thereby providing stiffness to the frame profile member. The crossbar 38 may be connected to the vertical plate section 56, for instance by welding or any other suitable means. Whereas in the embodiment of FIG. 7, the second oblique plate section 29 together with the first oblique plate section 21 form a channel 32 guiding the edge element 24, in the embodiment illustrated in FIG. 25, no such guiding channel is formed. Therefore, in the latter embodiment, the recess 62 of the edge element 55 in which the second end 48 of the spring element 27 is inserted, has been provided with higher wall portions resulting in a deeper recess supporting the spring element 27 appropriately in relation to the edge element 55. Thereby, the spring element 27 may guide the edge element 55 to slide along the surface of the first oblique plate section 21.

Many other embodiments of the building panel according to the present invention than those illustrated are possible. For instance, the embodiments of FIGS. 24 and 25 may be combined so that in the embodiment illustrated in FIG. 24, the second intermediate plate section 33 and the second oblique plate section 29 may be replaced by the vertical plate section 56 of the embodiment illustrated in FIG. 25, and the edge element 24 in FIG. 24 may, if necessary, be replaced by the edge element 55 in FIG. 25.

Furthermore, according to the present invention, at least some of the frame profile members 6, 7, 8, 9 of the building panel are formed by bending a corresponding edge area 14 of the metal plate 15 forming the plate member 10, thereby forming said frame profile members 6, 7, 8, 9 in one piece with the plate member 10, but some of the frame profile members 6, 7, 8, 9 of the building panel may be formed differently, such as being formed entirely or partly as a separate element being attached to the plate member 10, for instance by riveting or any other suitable connection means. It is also noted that, although in the illustrated embodiments, corner pieces 26 and corner bracket 34 are provided at the corners of the peripheral frame 5 in order to provide stiffness and/or for mounting purposes, such elements are not a requirement according to the present invention.

In an exemplary embodiment, a framework of a building panel according to the present invention includes a peripheral frame formed by four frame profile members and a plate member extending between the frame profile members. Three of the four frame profile members are formed by bending a corresponding edge area of a metal plate forming the plate member whereby each of these three frame profile members are straight profiles extending along a straight line. However, the fourth frame profile member is formed by bending a separate metal plate into the required cross-sectional form of the profile, preferably the same cross-sectional form as that of the three straight profiles, and subsequently roll-forming the resulting profile into a curved profile extending along a curved line. Alternatively, the curved profile may be produced by firstly extruding a straight profile and secondly roll-forming the straight profile into a curved profile. Finally, the curved profile is attached along a suitably curved edge of the plate member, preferably be welding or any other suitable means. Thereby, a building panel having three straight sides and one curved side may be obtained. Other configurations are possible, for instance a building panel having two straight sides and two curved sides. Of course, a separately attached profile may also be straight, and the profiles bent into one piece with the plate member may also be curved, if the material and required cross-sectional form of the profiles allow this.

LIST OF REFERENCE NUMBERS

A acute angle between first oblique plate section and plate member
1 building panel
2 framework
3 room-facing side of framework
4 building-facing side of framework
5 peripheral frame
6 first frame profile member
7 second frame profile member
8 third frame profile member
9 fourth frame profile member
10 plate member
11 textile
12 edge of textile
13 spring-biased tensioning mechanism
14 edge area of metal plate
15 metal plate forming plate member
16 rounded outer edge of frame profile member
17 room-facing side of plate member
18 building-facing side of plate member
19 room-facing of frame profile member
20 building-facing side of frame profile member
21 first oblique plate section of metal plate
22 first end of first oblique plate section
23 second end of first oblique plate section
24 edge element attached along edge of textile
25 first intermediate plate section
26 corner piece
27 spring element
28 cut-out in edge area of metal plate
29 second oblique plate section
30 first end of second oblique plate section
31 second end of second oblique plate section
32 channel between first and second oblique plate sections
33 second intermediate plate section
34 corner bracket
35 first flange of corner bracket
36 second flange of corner bracket

37 cut-out in first oblique plate section
38 crossbar
39 first connection bracket of crossbar
40 second connection bracket of crossbar
41 flange of connection bracket
42 cut-out in first oblique plate section
43 screw with rounded head
44 screw with flat head
45 corner cut-out in metal plate
46 coil spring
47 first end of spring element
48 second end of spring element
49 magnetic mounting bracket
50 mechanical mounting bracket
51 safety wire
52 mounting slot in connection bracket for safety wire
53 first alternative embodiment of frame profile member
54 second alternative embodiment of frame profile member
55 alternative embodiment of edge element attached along edge of textile
56 vertical plate section
57 alternative embodiment of spring element
58 first end of alternative embodiment of spring element
59 second end of alternative embodiment of spring element
60 cut-out in first oblique plate section of metal plate
61 toothed groove of edge element
62 recess of edge element
63 additional groove of edge element

The invention claimed is:

1. A building panel (1) adapted to be mounted at a ceiling or wall of a room so that a framework (2) of the building panel has a room-facing side (3) and a building-facing side (4), wherein the framework (2) includes a peripheral frame (5) formed by frame profile members (6, 7, 8, 9) and a plate member (10) extending between the frame profile members, wherein a textile (11) is extended over the room-facing side (3) of the framework (2) between the frame profile members (6, 7, 8, 9), and wherein each edge (12) of the textile (11) is attached to a corresponding frame profile member (6, 7, 8, 9) by means of a spring-biased tensioning mechanism (13), characterised in that at least some of the frame profile members (6, 7, 8, 9) are formed by bending a corresponding edge area (14) of a metal plate (15) forming the plate member (10), thereby forming said frame profile members (6, 7, 8, 9) in one piece with the plate member (10), in that said edge area (14) of the metal plate (15) forms a rounded outer edge (16) connecting a room-facing side (17) of the plate member (10) with a building-facing side (20) of the corresponding frame profile member (6, 7, 8, 9), in that the building-facing side (20) of the corresponding frame profile member (6, 7, 8, 9) includes a first oblique plate section (21) of the metal plate (15) forming an acute angle (A) with the plate member (10) and having a first end (22) and a second end (23), the first end (22) being connected to the rounded outer edge (16), in that the textile (11) is bent about the rounded outer edge (16) of said profile members (6, 7, 8, 9), and in that an edge element (24) attached along the corresponding edge (12) of the textile (11) is adapted to slide along the first oblique plate section (21) of the metal plate (15) and is spring-biased in a direction of the second end (23) of the first oblique plate section (21) of the metal plate (15), wherein the edge element (24) is spring-biased by means of a plurality of spring elements (27) extending through corresponding cut-outs (28) in said edge area (14) of the metal plate (15).

2. The building panel according to claim 1, wherein the first end (22) of the first oblique plate section (21) of the metal plate (15) is connected to the rounded outer edge (16) by means of a first intermediate plate section (25) extending at an angle in relation to the first oblique plate section (21) or extending at least substantially in parallel to the plate member (10).

3. The building panel according to claim 2, wherein the first intermediate plate section (25) and the plate member (10) tapers in relation to each other in the direction of the rounded outer edge (16) or the first intermediate plate section (25) extends in parallel to the plate member (10).

4. The building panel according to claim 3, wherein adjacent first and second frame profile members (7, 8) formed by bending the corresponding edge areas (14) of the metal plate (15) forming the plate member (10) are mutually connected by means of a corner piece (26) fitting between the plate member (10) and the respective first intermediate plate sections (25) of the first and second frame profile members (7, 8), said corner piece (26) preferably being a massive element and preferably being produced by moulding.

5. The building panel according to claim 4, wherein the edge element (24) is spring-biased by means of a number of spring elements (27) extending through corresponding cut-outs (28) in the first intermediate plate section (25) of the metal plate (15).

6. The building panel according to claim 5, wherein the building-facing side (20) of the corresponding frame profile member (6, 7, 8, 9) includes a second oblique plate section (29) of the metal plate (15) extending between a first end (30) and a second end (31) thereof and preferably being at least substantially parallel to the first oblique plate section (21), wherein the first end (30) of the second oblique plate section (29) is connected to the second end (23) of the first oblique plate section (21), wherein a channel (32) is formed between the first oblique plate section (21) and the second oblique plate section (29), and wherein the edge element (24) attached along the corresponding edge (12) of the textile (11) is adapted to slide into said channel (32).

7. The building panel according to claim 6, wherein the first end (30) of the second oblique plate section (29) of the metal plate (15) is connected to the second end (23) of the first oblique plate section (21) by means of a second intermediate plate section (33) preferably extending at least substantially in parallel to the plate member (10).

8. The building panel according to claim 6, wherein the adjacent first and second frame profile members (7, 8) formed by bending the corresponding edge areas (14) of the metal plate (15) forming the plate member (10) are mutually connected by means of a corner bracket (34), wherein the corner bracket (34) has a first flange (35) extending through a cut-out (37) in the first oblique plate section (21) of the first frame profile member (7) and a second flange (36) extending through a cut-out (37) in the first oblique plate section (21) of the second frame profile member (8).

9. The building panel according to claim 8, wherein the first and second flanges (35, 36) of the corner bracket (34) abut and are fixed to a plate section (33) of the metal plate being connected to the second end (23) of the first oblique plate section (21) and extending at least substantially in parallel to the plate member (10).

10. The building panel according to claim 9, wherein opposed first and second frame profile members (6, 7) formed by bending the corresponding edge areas (14) of the metal plate (15) forming the plate member (10) are mutually connected by means of a crossbar (38) provided with a first and a second connection bracket (39, 40) at its respective ends, and wherein each connection bracket (39, 40) has a flange (41) extending through a cut-out (42) in the first oblique plate section (21) of the respective frame profile member (6, 7).

11. The building panel according to claim 10, wherein the respective flanges (41) of the first and a second connection brackets (39, 40) abut and are fixed to the plate section (33) of the metal plate (15) being connected to the second end (23) of the first oblique plate section (21) and extending at least substantially in parallel to the plate member (10).

12. A method of manufacturing a building panel (1) adapted to be mounted at a ceiling or wall of a room so that a framework (2) of the building panel has a room-facing side (3) and a building-facing side (4), the framework (2) including a peripheral frame (5) formed by frame profile members (6, 7, 8, 9) and a plate member (10) extending between the frame profile members, whereby a textile (11) is extended over the room-facing side (3) of the framework (2) between the frame profile members (6, 7, 8, 9), and whereby each edge (12) of the textile (11) is attached to a corresponding frame profile member (6, 7, 8, 9) by means of a spring-biased tensioning mechanism (13), characterised by bending at least some edge areas (14) of a metal plate (15) forming the plate member (10), thereby forming corresponding frame profile members (6, 7, 8, 9) in one piece with the plate member (10), by forming, in said respective edge areas (14) of the metal plate (15), a rounded outer edge (16) connecting a room-facing side (17) of the plate member (10) with a building-facing side (20) of the corresponding frame profile member (6, 7, 8, 9), so that the building-facing side (20) of the corresponding frame profile member includes a first oblique plate section (21) of the metal plate (15) forming an acute angle (A) with the plate member (10) and having a first end (22) and a second end (23), the first end (22) being connected to the rounded outer edge (16), by bending the textile (11) about the rounded outer edge (16) of said profile members (6, 7, 8, 9), by adapting an edge element (24) attached along the corresponding edge (12) of the textile (11) to slide along the first oblique plate section (21) of the metal plate (15), and by spring-biasing the edge element (24) in a direction of the second end (23) of the first oblique plate section (21) of the metal plate (15) by means of a plurality of spring elements (27) extending through corresponding cut-outs (28) in said edge areas (14) of the metal plate (15).

13. The method according to claim 12, whereby a second oblique plate section (29) of the metal plate (15) extending between a first end (30) and a second end (31) thereof and being at least substantially parallel to the first oblique plate section (21) is formed by bending said edge areas (14) of the metal plate (15) so that the first end (30) of the second oblique plate section (29) is connected to the second end (23) of the first oblique plate section (21), whereby a channel (32) is formed between the first oblique plate section (21) and the second oblique plate section (29), and whereby the edge element (24) attached along the corresponding edge (12) of the textile (11) is adapted to slide into said channel (32).

14. A building panel (1) adapted to be mounted at a ceiling or wall of a room so that a framework (2) of the building panel has a room-facing side (3) and a building-facing side (4), wherein the framework (2) includes a peripheral frame (5) formed by frame profile members (6, 7, 8, 9) and a plate member (10) extending between the frame profile members, wherein a textile (11) is extended over the room-facing side (3) of the framework (2) between the frame profile members (6, 7, 8, 9), and wherein each edge (12) of the textile (11) is attached to a corresponding frame profile member (6, 7, 8, 9) by means of a spring-biased tensioning mechanism (13), characterised in that at least some of the frame profile members (6, 7, 8, 9) are formed by bending a corresponding edge area (14) of a metal plate (15) forming the plate member (10), thereby forming said frame profile members (6, 7, 8, 9) in one piece with the plate member (10), in that said edge area (14) of the metal plate (15) forms a rounded outer edge (16) connecting a room-facing side (17) of the plate member (10) with a building-facing side (20) of the corresponding frame profile member (6, 7, 8, 9), in that the building-facing side (20) of the corresponding frame profile member (6, 7, 8, 9) includes a first oblique plate section (21) of the metal plate (15) forming an acute angle (A) with the plate member (10) and having a first end (22) and a second end (23), the first end (22) being connected to the rounded outer edge (16), in that the textile (11) is bent about the rounded outer edge (16) of said profile members (6, 7, 8, 9), and in that an edge element (24) attached along the corresponding edge (12) of the textile (11) is adapted to slide along the first oblique plate section (21) of the metal plate (15) and is spring-biased in a direction of the second end (23) of the first oblique plate section (21) of the metal plate (15), wherein the first end (22) of the first oblique plate section (21) of the metal plate (15) is connected to the rounded outer edge (16) by means of a first intermediate plate section (25) extending at an angle in relation to the first oblique plate section (21) or extending at least substantially in parallel to the plate member (10), wherein the first intermediate plate section (25) and the plate member (10) tapers in relation to each other in a direction of the rounded outer edge (16) or the first intermediate plate section (25) extends in parallel to the plate member (10), wherein adjacent first and second frame profile members (7, 8) formed by bending corresponding edge areas (14) of the metal plate (15) forming the plate member (10) are mutually connected by means of a corner piece (26) fitting between the plate member (10) and the respective first intermediate plate sections (25) of the first and second frame profile members (7, 8), said corner piece (26) preferably being a massive element and preferably being produced by moulding, wherein the edge element (24) is spring-biased by means of a plurality of spring elements (27) extending through corresponding cut-outs (28) in said edge area (14) of the metal plate (15).

15. The building panel according to claim 14, wherein the edge element (24) is spring-biased by means of a number of spring elements (27) extending through the corresponding cut-outs (28) in the first intermediate plate section (25) of the metal plate (15).

16. The building panel according to claim 15, wherein the building-facing side (20) of the corresponding frame profile member (6, 7, 8, 9) includes a second oblique plate section (29) of the metal plate (15) extending between a first end (30) and a second end (31) thereof and preferably being at least substantially parallel to the first oblique plate section (21), wherein the first end (30) of the second oblique plate section (29) is connected to the second end (23) of the first oblique plate section (21), wherein a channel (32) is formed between the first oblique plate section (21) and the second oblique plate section (29), and wherein the edge element (24) attached along the corresponding edge (12) of the textile (11) is adapted to slide into said channel (32).

17. The building panel according to claim 16, wherein the first end (30) of the second oblique plate section (29) of the metal plate (15) is connected to the second end (23) of the first oblique plate section (21) by means of a second intermediate plate section (33) preferably extending at least substantially in parallel to the plate member (10).

18. The building panel according to claim 16, wherein the adjacent first and second frame profile members (7, 8) formed by bending the corresponding edge areas (14) of the metal plate (15) forming the plate member (10) are mutually connected by means of a corner bracket (34), wherein the corner bracket (34) has a first flange (35) extending through a cut-out (37) in the first oblique plate section (21) of the first frame profile member (7) and a second flange (36) extending through a cut-out (37) in the first oblique plate section (21) of the second frame profile member (8).

19. The building panel according to claim 18, wherein the first and second flanges (35, 36) of the corner bracket (34) abut and are fixed to a plate section (33) of the metal plate being connected to the second end (23) of the first oblique plate section (21) and extending at least substantially in parallel to the plate member (10).

20. The building panel according to claim 19, wherein opposed first and second frame profile members (6, 7) formed by bending the corresponding edge areas (14) of the metal plate (15) forming the plate member (10) are mutually connected by means of a crossbar (38) provided with a first and a second connection bracket (39, 40) at its respective ends, and wherein each connection bracket (39, 40) has a flange (41) extending through a cut-out (42) in the first oblique plate section (21) of the respective frame profile member (6, 7).

21. The building panel according to claim 20, wherein the respective flanges (41) of the first and a second connection brackets (39, 40) abut and are fixed to the plate section (33) of the metal plate (15) being connected to the second end (23) of the first oblique plate section (21) and extending at least substantially in parallel to the plate member (10).

* * * * *